United States Patent [19]

Lührsen et al.

[11] Patent Number: 4,508,324

[45] Date of Patent: Apr. 2, 1985

[54] FASTENING MEANS FOR A CLOSURE PLATE ON A SLIDING SHUTTER OUTLET IN A VESSEL WHICH CONTAINS MOLTEN METAL

[75] Inventors: Ernst Lührsen, Bad Schwalbach; Siegfried Pohl, Wiesbaden-Medenbach; Jürgen Plath, Wiesbaden, all of Fed. Rep. of Germany

[73] Assignee: Didier-Werke AG, Wiesbaden, Fed. Rep. of Germany

[21] Appl. No.: 502,948

[22] Filed: Jun. 17, 1983

[30] Foreign Application Priority Data

Jun. 22, 1982 [DE] Fed. Rep. of Germany ..... 3223181

[51] Int. Cl.[3] ..... B22D 41/08

[52] U.S. Cl. ..... 266/236; 266/271; 266/287; 222/600; 222/603

[58] Field of Search ..... 266/287, 236, 220, 271; 222/600, 603, 561; 29/157.1 R; 137/329.01; 251/326

[56] References Cited

U.S. PATENT DOCUMENTS

| | | | |
|---|---|---|---|
| 4,141,478 | 2/1979 | Meier | 222/600 |
| 4,220,269 | 9/1980 | Beckers et al. | 251/326 |
| 4,265,379 | 5/1980 | Meier | 222/600 |

FOREIGN PATENT DOCUMENTS

| | | | |
|---|---|---|---|
| 0083249 | 11/1977 | Australia | 222/600 |
| 2620423 | 11/1977 | Fed. Rep. of Germany . | |
| 2821839 | 11/1979 | Fed. Rep. of Germany . | |

*Primary Examiner*—L. Dewayne Rutledge
*Assistant Examiner*—S. Kastler
*Attorney, Agent, or Firm*—Nils H. Ljungman

[57] ABSTRACT

The invention resides in a fastening means for a closure plate on a sliding shutter for the outlet of a vessel containing molten metal, whereby the closure plate can be fixed within a supporting frame by the action of releasable gripping means which are provided on the supporting frame and which act on a metal sheath which at least encircles the periphery of the closure plate. The closure plate's external periphery is provided with at least one recess into which the sheath is pressed as a result of the deformation produced by the gripping means. According to an alternative embodiment of the invention, the sheath encircles the exterior periphery of the closure plate as a narrow tension band and is provided with at least one tightener. The desired pretensioning of the sheath and the fixing of the closure plate and sheath to the supporting frame is effected in combination with the tightener.

27 Claims, 7 Drawing Figures

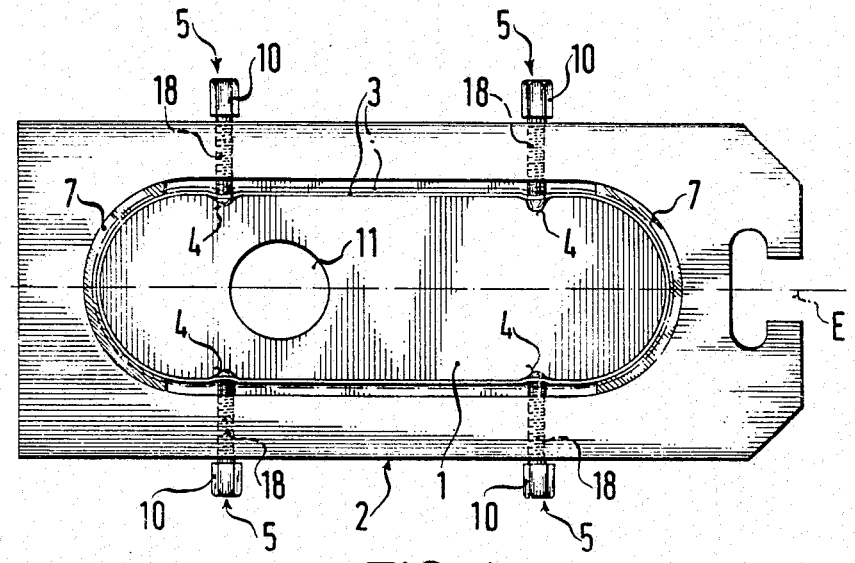
FIG. 1
FIG. 2a
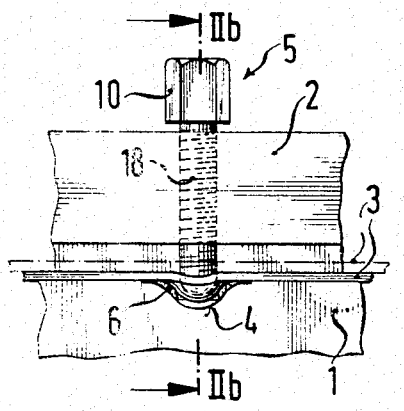
FIG. 2b
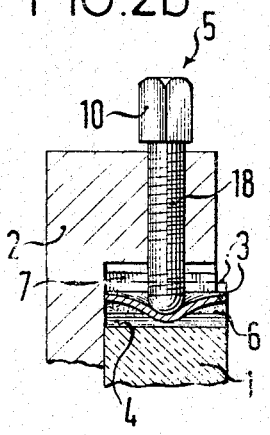

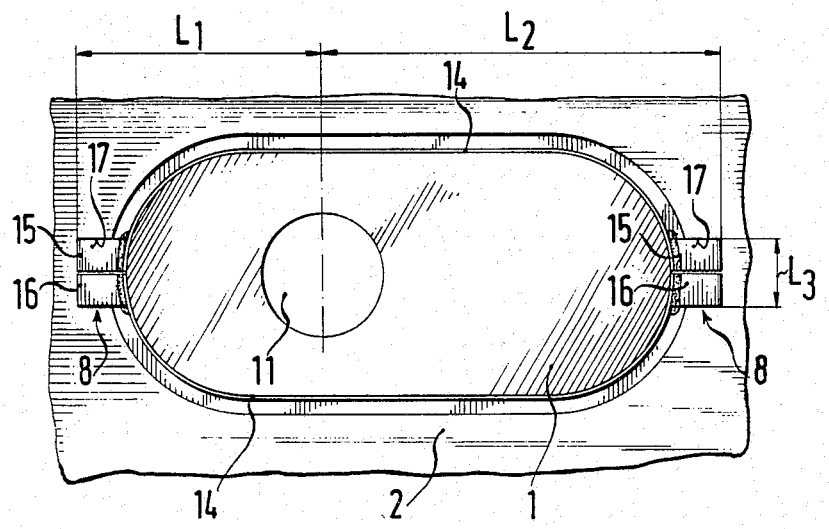
FIG. 3
FIG. 4a
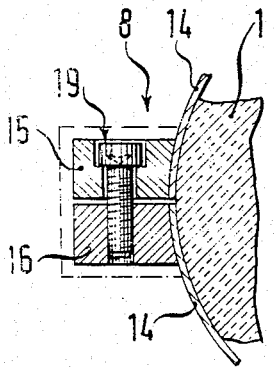
FIG. 4b
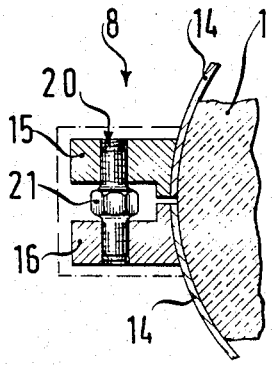
FIG. 4c
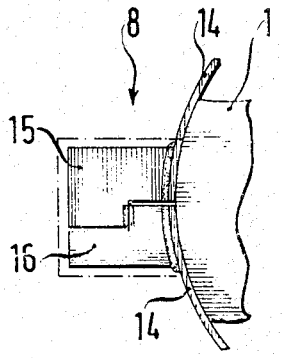

FASTENING MEANS FOR A CLOSURE PLATE ON A SLIDING SHUTTER OUTLET IN A VESSEL WHICH CONTAINS MOLTEN METAL

BACKGROUND OF THE INVENTION

1. Field of the Invention

The invention is generally directed to an outlet on a vessel which contains a molten charge. More particularly, the invention provides a releasable fastening means for a closure plate, such as, a ceramic slide-plate on a sliding shutter for the aforementioned outlet. According to this invention, the closure or slide-plate is securely mounted on a supporting frame by a gripping means which is provided on the supporting frame and which cooperates with a metallic sheath which surrounds the closure plate, at least about the periphery thereof.

2. Description of the Prior Art

It has been the practice to mount the refractory closure plate of a sliding shutter, for the outlet of a vessel containing molten metal, in a supporting frame with mortar. Typically, the refractory closure plate was also encased in a metallic sheath about its periphery prior to the bonding to the frame with mortar. The installation and removal of the closure plate according to this conventional method has been very labor-intensive. It is also known to mount a metal sheathed refractory closure plate into place on the supporting frame by means of a releasable eccentric which acts on the metal sheaths as described in German Patent Publication DE-AS 28 21 839 corresponding to U.S. Pat. No. 4,265,379 entitled Closure Element of a Slide Closure for use in Liquid Melt Containers which relates to sliding closure for casting orifice of molten metal bath, comprises wear elements held by eccentric elements used for moving a slide plate. This patent is incorporated herein by reference.

In this reference, the metal sheath which was typically shrunk onto the closure plate, served to hold the refractory material together when cracks occurred in the material during vessel operation due to the high stresses resulting from severe temperature changes. Moreover, the refractory material undergoes shrinkage, which can be quite appreciable. In closure plates made of zirconium oxide ($ZrO_2$), it is not, in all cases, sufficient simply to shrink-on the metal sheath in order to clamp the material effectively in place. In addition, there exists a danger that the metal sheath is too loosely seated or that the closure plate becomes warped by the improper shrinking of the metal sheath thereon, thus making it necessary to re-grind the closure and sealing faces. The choice of metal sheaths and closure plates with accurately matching properties, i.e., the same or similar coefficients of thermal expansion, and also precisely matching the closure plate periphery to exact size becomes excessively expensive.

OBJECT OF THE INVENTION

It is, therefore, an object of this invention to provide a fastening means for the retention of the closure plate and the sheath within the supporting frame without the use of mortar. Moreover, the fastening means is adapted to accommodate differences in dimensions between the refractory closure plate and the metal sheath.

SUMMARY OF THE INVENTION

The invention resides in a securing or fastening arrangement for removably mounting a closure plate within a supporting member attached to or forming part of a vessel for holding a molten metal. The closure plate is typically adapted to receive a sliding shutter type valve or other valve to control the flow of molten metal from the vessel. A metal sheath encircles the edge of the plate along its periphery. The metal sheath is tightened prior to the use of the vessel by a tightening arrangement which causes the sheath to tightly grip the edge of the plate.

In one of the embodiments of the invention, the closure plate has an edge with at least one recess therein and the metal sheath about the periphery covering the edge. A supporting member is adapted to receive the sheathed closure plate in a removably mounted relationship. Releasable gripping means are operably associated with the supporting member for selectively engaging the sheathed closure plate such that a portion of the sheath adjacent to the at least one recess is pressed into the recess thereby securing the sheath about the periphery of the plate.

In an alternative embodiment, the fastening means includes a metal sheath in the form of a tensioning band with at least one tightening arrangement attached to the ends of the at least one band for securing same to the closure plate. The supporting member has a recess therein adapted to receive the tightening arrangement and thereby retain the sheathed closure plate. Each tightening means includes two tensioning blocks which can be bolted or welded together in a closed relationship. The tightening arrangement can be machined as necessary after closure in order to be compatible with associated recess means in the supporting member recess.

In either embodiment, a lubricant selected from the group consisting of graphite foil and ceramic fiber can be disposed between the sheath and the closure plate.

BRIEF DESCRIPTION OF THE DRAWINGS

The above, as well as other features and advantages of this invention, will be more readily appreciated through consideration of the detailed description of the embodiments of this invention in conjunction with the several figures in which:

FIG. 1 is a schematical plan view of a closure plate of a linear sliding shutter in which a metallic sheath and refractory closure plate are mounted in a supporting frame according to one embodiment of this invention;

FIG. 2*a* is a side elevation of portion of the supporting frame and the closure plate in the region of a fastening means;

FIG. 2*b* is a cross-section taken along the line II-*b*—II*b* of FIG. 2*a;*

FIG. 3 is a schematic plan view of a supporting frame with a slide-plate of a linear sliding shutter according to an alternative embodiment of this invention;

FIG. 4*a* is a cross-sectional detail illustrating a first technique for securing the metallic sheath to the closure plate according to the embodiment of FIG. 3;

FIG. 4*b* is a cross-sectional detail illustrating a second technique for securing the metal sheath to the closure plate according to the embodiment of FIG. 3; and FIG. 4*c* is a cross-sectional detail illustrating a third technique for securing the metal sheath to the closure plate according to the embodiment of FIG. 3.

DETAILED DESCRIPTION OF THE PREFERRED EMBODIMENT OF THE INVENTION

While the present description and illustration are directed to a linear slide closure plate, it is to be understood that the invention is clearly suitable for use in rotary slide valves and the like.

Turning to FIGS. 1, *2a* and *2b*, there is shown a refractory element such as a closure plate 1 mounted on a supporting frame 2 for use in combination with a slide closure, for example, having a ring closure mechanism gate-type valve which discharges molten metal from a vessel such as a liquid melt container through an outlet opening 11 in the closure plate 1. In this embodiment of the invention, each of the long sides of the closure plate 1 has two groove-shaped recesses 4 which are preferably equally spaced and lie with mirror symmetry on either side of the slide-plate's longitudinal vertical bisecting plane E. The closure plate 1 is enclosed, at least along outer periphery, by a sheet metal sheath 3 which initially has the shape illustrated by the dot-dash line. After the unit, comprising the closure plate 1 and the sheath 3, is put into place in the supporting frame 2, the gripping means 5, which are located in the region of the recesses 4 and which take the form of the threaded bolts 18, secured in the support frame 2, are tightened. The bolts 18 are shown to pass through the support frame 2 in order to make contact with and tighten the sheath 3. The tightening of the threaded bolts 18 is effected, for example, by the use of a torque wrench designed to engage the correspondingly formed head 10 of the bolt 18. As an example, the head 10 is shown to be hexagonal. On being tightened, the front ends of the bolts 18 press down on the sheath 3 as shown in FIGS. *2a* and *2b*. The sheath 3 is thereby deformed and partially pressed down into the recesses 4. The sheath then takes the final position illustrated by the solid line in which the closure plate 1 lies gripped by the supporting frame 2, both centered and fixed in position. This happens because the deformation of the sheath 3 causes the latter to grip around the entire outer periphery of the closure plate 1. The gripping force can be adjusted by the torque applied to the bolts 18 which are threaded into the support frame 2 by conventional means well known in the prior art. As is common with linear sliding shutters, the closure plate 1 has an elongated shape with two essentially parallel long sides in which the recesses 4 are located, and two essentially semicircular end faces connected by these long ends. If the gripping means 5, which take the form of the threaded bolts 18 in this embodiment of the invention, should prove to be inadequate for fixing and holding the closure plate 1, suitably rounded locking wedges 7 can be driven in, in the region of the end faces of the closure plate 1, between the sheath 3 and the supporting frame 2 as shown in FIG. 1. For directing the tightening force exerted by the threaded bolts 18, it can be advantageous to provide, at least in the region of the lead-in radii of the recesses 4, a lubricant 6 which would preferably be a graphite foil or ceramic fiber.

Special advantages of the solution in accordance with the embodiment of the invention shown in FIGS. 1, *2a* and *2b*, reside in the fact that plate and/or sheath tolerances are unimportant as far as gripping the plate 1 is concerned, and in fact, the gripping forces acting on the closure plate 1 can be held constant by preventing different shrinkage forces from arising as the result of differential shrinkage of the plate material. Other advantages also reside in the fact that the installation and removal of the closure plate or the assembly consisting of the closure plate and the sheet metal sheath 3 are extremely reliable and simple. Initially, the sheet metal sheath 3 can be placed comparatively loosely around the closure plate's periphery or the closure plate 1 can be set loosely in the sheet metal sheath 3 which is already mounted on the supporting frame 2. By actuating the gripping means 5, the sheath 3 is locally forced and deformed into the recess or recesses 4 in the closure plate 1. By this means, not only is the closure plate 1 fixed to the supporting frame 2, but is centered simultaneously, so that the closure plate's outlet opening is constrained to take up the correct position with respect to the supporting frame 2. Re-matching of the periphery of the plate 1 is unnecessary. When the sheet metal sheath 3 only has the form of a tension band which passes around the periphery of the plate 1, the plate 1 can easily be turned around in its supporting frame 2.

Advantageously, the recesses 4, of which there is at least one, are made in the form of a groove the longitudinal axis of which is perpendicular to the plane of the plate 1. By this technique one and the same gripping device 5 can be used, without further ado, for plates having different thicknesses.

When, for a linearly sliding shutter, the closure plate's exterior periphery has two long sides which are essentially parallel, the recess, if only one is present, is preferably located on one of the long sides, for example, at the middle of this long side. However, at least one recess can be provided on each long side. Preferably, as shown in FIG. 1, the recesses 4 are located mirror-symmetrically with respect to the closure plate's vertical bisecting plane E. An especially simple form of gripping means 5 is obtained when the gripping means 5 is made in the form of a threaded bolt 18 which is rotatably held in the supporting frame 2, with the end of the bolt 18 acting on the sheath 3. If the bolt 18 considered is provided with a head 10 designed to be gripped by a wrench such as, for example, a torque wrench, precise adjustment of the gripping force becomes possible along with easy assembly.

Should it be required, the at least one recess 4 is provided, in the region of its entry radius at its bottom portion as shown in FIGS. *2a* or *2b*, with a lubricant which, for example, is in the form of a graphite foil or a ceramic fiber. By this means, the directing of the force of the gripping means 5, that is, of the threaded bolts 18, is improved.

In the event that the gripping action produced by the deformation of the sheath 3 by the gripping means 5, for example, by the threaded bolts 18, should be inadequate, at least one locking wedge 7 can be driven in between the sheath 3 and the supporting frame 2. When the external periphery of the closure plate 1 for a linear sliding shutter is provided with two essentially semicircular faces, a correspondingly rounded locking wedge 7 is advantageously provided in the region of each semicircular face.

Considering FIGS. 3 and *4a* through *4c*, an alternative embodiment of the invention shows the closure plate 1 exclusively encircled or sheathed by a two-piece tension band 14. The gripping of the closure plate 1 is effected by action of two tightening means 8 provided at the end faces of the closure plate 1. At each end of a half section of the tension band 14 are a respective tensioning blocks 15 and 16. Thus the two sections of the tension band 14 are brought together to exert a specified force about the closure plate 1, from an open aligning position to a closed stressed position or setting. While a two section tension band is shown, a single tension band with a tensioning block 15 and 16 at each end thereof can be utilized.

As shown in FIG. 4*a*, the tensioning blocks 15 and 16 are connected by means of a bolt 19 within a recessed section and, as shown in FIG. 4*b*, the blocks are pulled together by means of a left and right-handed screw 20 which can be actuated via an periphery hexagonal section 21 between the left and right-handed screw sections.

In the example of one of the tightening means 8, shown in FIG. 4*c*, the tensioning blocks 15 and 16 are forced together by a separately provided external chuck, not shown, and then welded together. Based on the specified values of the dimensions $L_1$, $L_2$ and $L_3$, as shown in FIG. 3, the tensioning blocks 15 and 16, when in the closed position, fit into the corresponding recesses 17 in the supporting frame 2. Because, with the same gripping force, the gap between the two tensioning blocks depends on the variable length of the external periphery of the closure plate 1, the tensioning blocks 15 and 16 can assume different external dimensions when in their braced position, and as a result, the exterior surfaces of the tensioning blocks 15 and 16 are preferably re-machined after the tightening operation, as indicated by the broken lines in FIGS. 4*a* to 4*c*, until each of the tightening means 8 fits its corresponding one of the recesses 17.

In this embodiment of the invention, the tensioning blocks 15 and 16 fit firmly by being forced into corresponding recesses 17 in the supporting frame 2 only when in their tightened and stressed position or state. By this technique, the closure plate 1 can be simultaneously reliably and simply mounted in its correct position on the supporting frame 2. In this manner the tensioning blocks 15 and 16, after being brought together into their tightened position, preferably, are re-machined or re-ground, for example, along their exterior side faces so as to fit into the recesses. In this way, it is possible to compensate for any dimensional differences in the periphery of the plate, such differences which could lead to gaps having different widths between the tensioning blocks 15 and 16 when in their tightened and stressed position.

As shown in FIGS. 4*a* through 4*c*, the tensioning blocks can, on the one hand be made adjustable by means of a threaded bolt, such as 19 or 20, which connects the blocks. However, it has been found to be particularly advantageous that the tensioning blocks 15 and 16 be welded together after being brought together in the tightening or stressed position. With this proposed solution, by contrast to the use of threaded bolts 19 or 20, the forces in tension can be better applied in the peripheral direction because, by contrast with those of threaded bolts 19 or 20, the points of application of the forces can lie directly upon and all along the periphery of the plate 1.

In order to re-direct the gripping forces, a lubricant can be provided which, for example, can take the form of a graphite foil or ceramic fibers, disposed between the tension band 14 and the outer periphery of the closure plate 1 in a manner which may be analogous to that shown in FIGS. 2*a* and 2*b*.

As a rule, the closure plates 1 of linear sliding shutters, or alternatively, gate type valves have two faces which have ends that are rounded into an essentially semicircular form, with two essentially parallel long sides connecting these ends. However, in accordance with a further proposed embodiment of the invention, the gripping action can be still further improved when the tension band abuts externally against the rounded faces of the closure plate's outer periphery's non-parallel or outwardly projecting long sides of long side sections which, for example, run conically with respect to each other. Also, closure plates fitted with a tension band can be additionally braced in the longitudinal direction in the supporting frame, for example, by means of eccentrics, tightening screws, wedges, compensators, or the like.

The embodiment of the invention, in accordance with FIGS. 1, 2*a* and 2*b*, is more suitable for gripping the plate in applications in steelworks, whereas, with the embodiment in accordance with FIGS. 3 and 4*a* through 4*c*, the sheet metal sheath can already be fixed in place in the refractory component manufacturing plant.

The invention, as described hereinabove in the context of a preferred embodiment, is not to be taken as limited to all of the provided details thereof, since modifications and variations thereof may be made without departing from the spirit and scope of the invention.

What is claimed is:

1. A securing device for removably mounting a closure plate to a supporting frame member, said closure plate being adaptable for receiving valving means of said supporting frame member when said closure plate is mounted on a vessel for containing molten metal, said securing means comprising in combination:

a closure plate with a removable band-like metal sheath adapted to completely encircle at least the periphery around the edge thereof;

said sheathed closure plate being adapted to be removably received and retained in said supporting frame member;

adjustable tightening and securing means for tightening said metal sheath to grip said closure plate and for fastening said closure plate within said supporting frame wherein said closure plate includes at least one recess in its periphery, and said tightening and securing means comprises an adjustable fastening member supported by said frame member and having at least one end section which, in assembly, tends to extend into said at least one recess by deforming and forcing a portion said band-like sheath adjacent said at least one recess into said at least one recess thereby removably securing said sheath about the entire periphery of said closure plate.

2. The securing device according to claim 1 wherein said tightening and securing means includes a plurality of recesses in said closure plate for receiving a portion of said sheath adjacent each said recess when forced and deformed thereinto by the tightening action of said tightening and securing means.

3. The securing means according to claim 1 wherein said sheath comprises a narrow band, said tightening and securing means comprises bolt means for tensioning said narrow band about the periphery of said closure plate by pressing said sheath into said at least one recess.

4. A fastening means for removably mounting a closure plate to a supporting frame member on a vessel which contains molten metal, said closure plate adapted to receive a sliding shutter type valve, said fastening means comprising in combination:

a closure plate;

a removable metal sheath adapted to encircle at least the periphery of said closure plate, said metal sheath defined by at least one narrow tension band having at least one adjustable tightener means for tightening and securing said tension band about said closure plate periphery; and a frame member including at least one recess adapted and located to receive in a positive locking relationship the at least one adjustable tightener means such that the sheathed closure plate is received by said frame member and removably retained therein.

5. The fastening means according to claim 4 wherein said tension band is open ended with two ends, and wherein said at least one tightener means includes at least one set of two tensioning blocks fixed to said two ends, one at each end, which can be brought together to exert a specified force on the tension band when manipulating said tension band from an open to a closed, sheathed position.

6. The fastening means according to claim 4 wherein the tension band comprises two portions, the fastening means comprising two tightener means mounted on said supporting member, said supporting member having two of said recesses, each said recess being disposed to register with one tightener means.

7. The fastening means according to claim 5 wherein the two tensioning blocks are welded together after tensioning the band.

8. The fastening means according to claim 5 wherein each set of said at least one set of two tensioning blocks can be brought together in a closed relationship and include threaded bolt means for tensioning said band and effecting said closed relationship.

9. The fastening means according to claim 4 wherein the combination includes a lubricant disposed between the tension band and the closure plate.

10. The fastening means according to claim 9 wherein the lubricant is selected from the group consisting of graphite foil and ceramic fibers.

11. A fastening means for removably mounting a closure plate to a supporting member in a sliding shutter type valve on a vessel for containing a molten metal, said fastening means comprising in combination:

a closure plate having at least one recess in the edge thereof:

a band-like metal sheath which encloses the entire periphery of said closure plate, covering said at least one recess;

a supporting frame member adapted to receive in a removably mounted relationship said sheathed closure plate; and adjustable gripping means mounted on said supporting frame member and operably associated with said supporting frame member for selectively engaging said sheathed closure plate such that a portion of said sheath adjacent said at least one recess is pressed into said at least one recess in said closure plate upon the engagement thereof by said gripping means.

12. The fastening means according to claim 11 wherein the at least one recess in the closure plate defines a groove which is perpendicular to the plane of the closure plate.

13. The fastening means according to claim 12 wherein the closure plate is adapted for a linear sliding shutter and has two essentially parallel, long sides and the at least one recess is located in one of said long sides.

14. The fastening means according to claim 13 wherein the closure plate includes at least one recess in each of the two long sides.

15. The fastening means according to claim 14 wherein the at least one recess in each of the two long sides thereof is located with mirror-like symmetry with respect to the longitudinal, vertical bisecting plane of the closure plate.

16. The fastening means according to claim 11 wherein said adjustable gripping means comprises a threaded bolt which is rotatably mounted in the supporting frame member, the threaded end of said bolt acting on the sheath at said at least one recess.

17. The fastening means according to claim 16 wherein the threaded bolt includes a head adapted to receive a turning tool.

18. The fastening means according to claim 13 wherein the closure plate includes two arcuate end-sides having a recess and wherein the closure plate includes in the region of the at least one radius a lubricant disposed between the sheath and the closure plate.

19. The fastening means according to claim 18 wherein the lubricant is selected from the group consisting of graphite foil and ceramic fibers.

20. The fastening means according to claim 19 wherein the combination includes a locking wedge adapted to be driven between the sheath and the supporting member.

21. The fastening means according to claim 20 wherein the closure plate has an external periphery defined by two end faces rounded into essentially semicircular form and wherein the locking wedge is correspondingly rounded for insertion between the sheathed closure plate and the supporting member proximate said end faces.

22. A fastening means for removably mounting a closure plate to a supporting frame member on a vessel which contains molten metal, said closure plate adapted to receive a sliding shutter type valve, said fastening means comprising in combination:

a closure plate;

a removable metal sheath adapted to encircle at least the periphery of said closure plate, said metal sheath defined by at least one narrow tension band having at least one adjustable tightener means for tightening and securing said tension band about said closure plate periphery;

a lubricant disposed between said metal sheath and said closure plates; and a frame member including at least one recess adapted and located to receive in a positive locking relationship the at least one adjustable tightener means such that the sheathed closure plate is received by said frame member and removably retained therein.

23. The fastening means according to claim 22 wherein the lubricant is selected from the group consisting of graphite foil and ceramic fibers.

24. A fastening means for removably mounting a closure plate to a supporting member in a sliding shutter type valve on a vessel for containing a molten metal, said fastening means comprising in combination:

a closure plate having at least one recess in the edge thereof;

a band-like metal sheath which encloses the entire periphery of said closure plate, covering said at least one recess;

a lubricant disposed between said metal sheath and said closure plate in the region of the at least one recess;

a supporting frame member adapted to receive in a removably mounted relationship said sheathed closure plate; and adjustable gripping means mounted on said supporting frame member and operably associated with said supporting frame member for selectively engaging said sheathed closure plate such that a portion of said sheath adjacent said at least one recess is pressed into said at least one recess in said closure plate upon the engagement thereof by said gripping means.

25. The fastening means according to claim 24 wherein the lubricant is selected from the group consisting of graphite foil and ceramic fibers.

26. The fastening means according to claim 25 wherein the combination includes a locking wedge adapted to be driven between the sheath and the supporting member.

27. The fastening means according to claim 26 wherein the closure plate has an external periphery defined by two end faces rounded into essentially semicircular form and wherein the locking wedge is correspondingly rounded for insertion between the sheathed closure plate and the supporting member proximate said end faces.

* * * * *